US005186428A

United States Patent [19]

Falkenberg

[11] Patent Number: 5,186,428

[45] Date of Patent: Feb. 16, 1993

[54] DEPTH GAUGE TRANSDUCER RETRACTOR DEVICE

[75] Inventor: E. Frank Falkenberg, Trevose, Pa.

[73] Assignee: Canyon Enterprises, Inc., Trevose, Pa.

[21] Appl. No.: 821,383

[22] Filed: Jan. 10, 1992

Related U.S. Application Data

[63] Continuation of Ser. No. 629,995, Dec. 19, 1990, abandoned.

[51] Int. Cl.[5] ..... H04R 1/00

[52] U.S. Cl. ..... 248/284; 248/642; 440/2; 367/173; 367/165

[58] Field of Search ..... 248/284, 640, 642, 652; 114/343; 440/2; 367/173, 165

[56] References Cited

U.S. PATENT DOCUMENTS

| | | | |
|---|---|---|---|
| 2,780,196 | 2/1957 | Jareckie | 367/173 X |
| 3,740,706 | 6/1973 | Joseph | 367/173 |
| 4,285,485 | 8/1981 | Burke | 367/173 X |
| 4,354,848 | 10/1982 | Hall et al. | 248/642 X |
| 4,667,915 | 5/1987 | Boucher et al. | 248/642 X |
| 4,888,747 | 12/1989 | Williams | 367/173 |
| 4,926,399 | 5/1990 | Hickman | 367/173 |

*Primary Examiner*—Karen J. Chotkowski
*Attorney, Agent, or Firm*—John J. Simkanich

[57] ABSTRACT

A retractor device is provided for selectively positioning a depth gauge transducer into the water and below the bottom line of a pleasure boat or retracting the transducer to an upwardly facing position above the water line. A compound lever system is mounted via a mounting bracket to be positioned adjacent to and above the normal water line of the boat. Alternately, the mounting position can be under the water line. This lever system includes a transducer carrying lever arm linked to an activator lever arm. These two lever arms are intended to rotate about there own individual pivot point on the mounting bracket and are linked with connection links at points intermediate their ends thereby causing the two levers to rotate together and have a bias to either of two rotational positions, the first being an extended position for the transducer into the water and the second being the retracted position above the water. In the extended position, the transducer carrying lever arm extends into the water to a point below the bottom line of the boat. Detents operating between the activator lever arm and the mounting bracket establish intermediate fixed rotational positions for the lever arms.

21 Claims, 3 Drawing Sheets

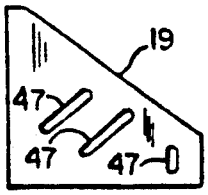
FIG. 5A
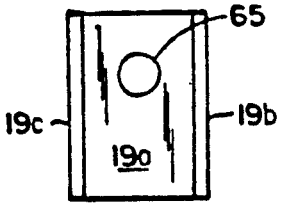
FIG. 5B
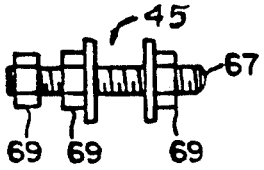
FIG. 6
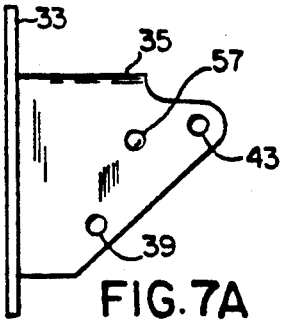
FIG. 7A
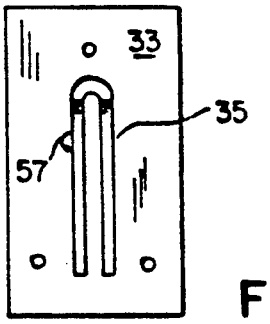
FIG. 7B
FIG. 8A
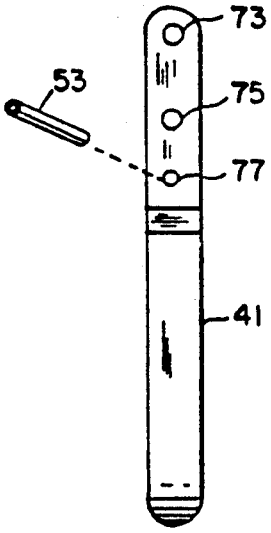
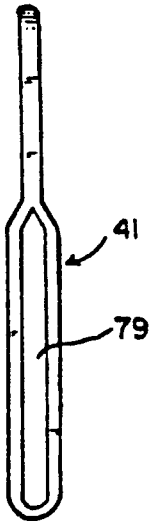
FIG. 8B
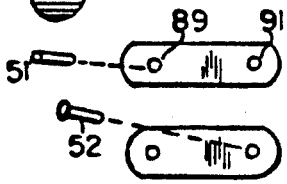
FIG. 10
FIG. 9A
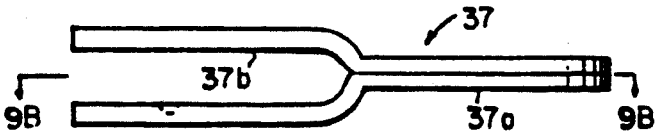
FIG. 9B
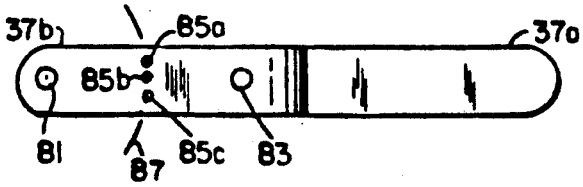

DEPTH GAUGE TRANSDUCER RETRACTOR DEVICE

This application is a continuation of application Ser. No. 07/629,995, filed Dec. 19, 1990, now abandoned.

BACKGROUND OF THE INVENTION

This invention relates to variable positioning retractor devices and in particular relates to retractor devices for mounting electronic equipment adjacent to the waterline on the hull of a boat.

Pleasure boats which, in recent years, have employed electronic sensing equipment vary in size from small runabouts to large yachts. These boats, whether 12 feet long or a 100 feet long have some factors in common. They are typically piloted by nonprofessional pilots and they are often hauled in and out of the water. This is especially true with smaller sized boats, even those as long as 30 feet.

These pleasure boats, therefore, often come in contact with bottom surfaces, including those times when they are hauled upon a trailer or are launched down a ramp, or they run aground.

Sensitive electronic devices, such as depth gauges and fish finders, utilize acoustic transducers which must be mounted on or adjacent to the hull of a boat. With small pleasure boats, the stern transom is a convenient location to mount depth gauge and other types of electronic acoustic transducers. These transducers must be mounted below the normal water line of the boat and it is preferred that they extend below the bottom line of the hull.

In the past, to hold these transducers, pleasure boaters have employed a fixed bracket mounted to the transom of the boat and extending below the bottom line of the hull. The transducer or other sensitive electronic equipment is then mounted on the bottom most edge of the bracket.

Several problems have occurred with this type of mounting. First if the boat hits bottom the delicate transducer or other electronic equipment can be easily damaged or completely broken away from its mounting and thereby completely lost even to the possibility of repair. Secondly, the transducer extending below the hull line is often damaged when the boat is hauled onto a trailer or launched down a ramp. Both of these circumstances require the cautious boat owner to disassemble his depth gauge transducer and bracket before hauling his boat or when he knows he will be in very shallow waters. This procedure requires, usually, a substantial amount of time to electrically disconnect the apparatus and to thereafter mechanically remove the apparatus and its mounting bracket. With very large yachts, having reasonably deep drafts, a diver may be needed to mount and unmount the fixed bracketed transducer apparatus.

A more common occurring problem is the build up of marine life and debris on the sensor head of a transducer. This occurs with both freshwater and saltwater use.

However, many pleasure craft are operated in salt water. These boats are left in the water for long periods of time. During this salt water residency, barnacles and other marine growth build up on the bottom of the boat as well as upon the depth gauge transducer and other electronic acoustic equipment. These growths impair the clarity and resolution of the electronic equipment transducers.

It is therefore desirable to be able to remove a transducer from a salt water environment at the end of a boating day. In this way barnacles and other marine life do not build up on the transducer. If needed, the retracted transducer can be easily accessed for cleaning or otherwise servicing.

It is further desirable to be able to retract or otherwise remove the transducer and other sensitive electronic equipment from the bottom line of the boat when the boat is in very shallow water or when it is being pulled onto a trailer or launched down a launching ramp.

It is further desirable to develop a retractor device which can hold the transducer at various positions intermediate its full retracted position and its fully extended position.

SUMMARY OF THE INVENTION

An object of the present invention is to provide an adjustable positioning device for holding a depth gauge acoustic transducer or other electronic acoustic device used on pleasure boats.

A second object of this invention is to provide such a positioning device which can retract and alternately extend the transducer or other acoustic device into and out of the water to a proper location when extended below the hull line of the pleasure boat.

A third object of this invention is to provide such an adjustable position retractor device with fixed intermediate positions between the fully retracted and the fully extended positions thereof.

An even further object of this invention is to provide such an adjustable position retractor device with the ability to move the acoustic transducer to a rotated position above the water line so that it may be out of the water when not in use.

The objects of the present invention are realized in a depth gauge transducer retractor device which can be mounted on the transom of a pleasure boat above the normal water line. This retractor device includes a base mounting bracket which is bolted or otherwise secured to the outward face of the boat's transom at an appropriate location above the water line. A compound rotational lever system is mounted to the base mounting bracket. The compound lever system includes two cooperating lever arms which rotate in two different arcs non-concentric about two different, but adjacent, pivot points.

The first of the lever arms acts as a handle or activator mechanism and rotates from essentially the horizontal position to the vertical position. The second lever arm which is acted upon by the first lever arm and which is intended to carry the transducer is caused to rotate from essentially a vertically extending downward position to a vertically extending upward position when the first level arm is moved to the vertical position. When both levers are in the vertical upward position, they extend parallel to one another.

The first lever arm or handle can be rotated upwardly or downwardly by the boat owner as desired. This may be done manually or through a motor driven or wench operated cable system.

A depth gauge acoustic transducer is mounted on the end of the second lever. A coupling bracket is used to hold the transducer on this transducer carrying and positioning lever arm. The transducer carrying lever arm is of sufficient length to extend the transducer to a desired depth below the bottom line of the boat's hull. When the retractor device is in the fully retracted position, the bottom face of the transducer is rotated in a circular arc to face upwardly for storage or servicing.

The length of the activator lever arm or handle can be adjusted to provide sufficient force consistent with the size and weight of the acoustic transducer which the retractor device positions.

A detent mechanism is incorporated into the path of motion of the handle or activator lever arm. This detent mechanism allows the handle to be fixedly positioned at a plurality of arc path locations between its fully retracted vertical position and its fully retracted horizontally position. This equates into the transducer carrying lever arm being fixedly positionable at a plurality of positions on its arc path of travel between its fully retracted position, this being the upper most upwardly facing position above the water line, and its fully extended position, this being the downward most downwardly facing position below the bottom line of the boat.

DESCRIPTION OF THE DRAWINGS

The features, advantages and operation of the present invention will better be understood from a reading of the following Detailed Description of the Invention in conjunction with the following drawings in which like numerals refer to like elements and which:

FIGS. 5*a* and 5*b* show two views of the transducer coupling bracket;

FIG. 6 shows the mounting bolt assembly for joining the transducer coupling bracket to the positioning lever arm of the retractor device;

FIGS. 7*a* and 7*b* show two views of the base mounting bracket of the retractor device;

FIGS. 8*a* and 8*b* show two views of the transducer holding and positioning second lever arm and roll pin stop member;

FIG. 9*a* shows a plan view of the activator lever arm or handle;

FIG. 9*b* shows a side view of one half of the handle lever arm taken as shown in FIG. 9*a;* and FIG. 10 shows the pair of short link arms for coupling an intermediate point along the transducer holding lever arm and an intermediate point along the activator lever arm or handle and a pair of pivot pins, one of which has a rounded detent operating head.

DETAILED DESCRIPTION OF THE INVENTION

Figure 1:
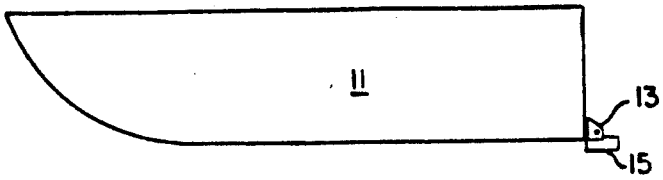
FIG. 1 (PRIOR ART)
FIG. 1 shows a side view of the hull of a pleasure boat and the previous method of mounting depth gauge transducers.

The present invention is an improvement over what has been done in the past, FIG. 1, where in the prior art a pleasure boat 11 hull had a fixed bracket 13 mounted at the bottom edge of its transom. A transducer 15 was mounted to the bottom of this bracket to extend below the bottom line of the boat 11.

Figure 2:
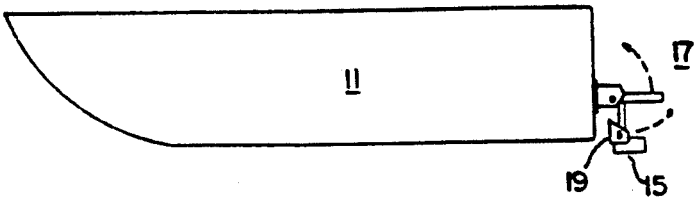
FIG. 2 shows a side view of a pleasure boat with the depth gauge transducer retractor device of the present invention mounted on its stern transom.

The present invention is a retractor device which is mounted to the transom of a boat 11 hull, FIG. 2. This retractor device 17 has rotating members and includes a transducer 15 mounting bracket 19 mounted on one end of one of the one members of the retractor device 17. This retractor device will be described in further detail below. However, it is intended in one embodiment to be manually operated.

Figure 2A:
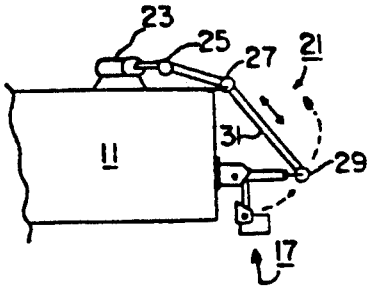
FIG. 2*a* shows a side view of a partial pleasure boat with a cable operated embodiment of the retractor device of FIG. 2.

In a second embodiment, a motor driven cable system 21 is added to the retractor device 17 structure, FIG. 2*a*. This motor driven cable system 21 includes a motor or wench activator 23 rotating a drive pulley 25. An idler pulley 27 is mounted at the top of the transom of the boat 11 and is used for the clearance of the cable as it rides over the edge of the boat 11. A take-up pulley 29 is mounted to a movable member of the retractor device 17. A cable 31 extends between all of the pulleys 25, 27, 29 and is used to rotate the retractor device upwardly and downwardly depending upon the direction of the cable 31 movement, thereby providing a mechanized substitution for the manual operation of the retractor device 17.

Figure 3:
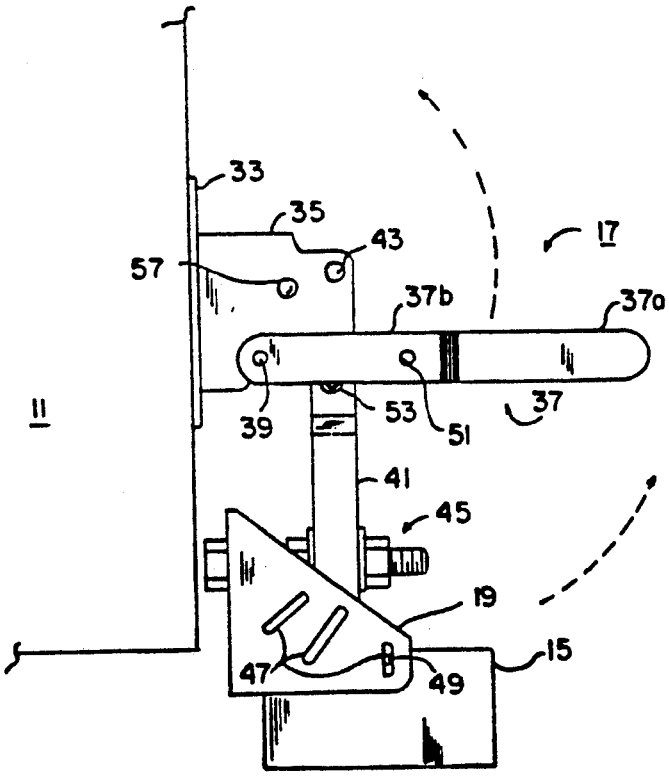
FIG. 3 shows a side view of the retractor device of the present invention in the fully extended position below the bottom line of the boat.

Retractor device 17 is shown in greater detail in FIG. 3. It includes a retractor lever mounting member which has a base mounting plate 33 bolted or screwed to the boat 11, and a bracket plate 35 or frame member extending outwardly from the mounting plate 33 at a 90 degree angle. The bracket plate 35 is U-shaped and has two parallel extending plate members which will described further below. The bracket plate 35 is welded or otherwise secured to the mounting plate 33.

A first lever arm 37 is pivotally mounted to a point near the bottom of the bracket plate 35 with a first pivot pin 39 extending through both plate members of the bracket plate 35. This first lever arm 37 has a single leg portion 37*a* and a parallel extending twin leg portion 37*b*. The first lever arm 37 is a straight lever so that there is a transition point where the single leg portion 37 forks out into a twin leg portion 37*b*, with the twin legs of that portion 37*b* extending in parallel.

It is to be noted, that the first lever arm 37 is the actuator mechanism for the operation of the retractor device 17. Typically, in manual operation, a boat owner will grasp the free end of the first lever arm 37 as a handle and rotate it between the shown horizontal position (FIG. 3) and a vertical position. The take-up pulley 29 of FIG. 2, when used, can be mounted to the outboard or free end of the first lever arm 37.

A second lever arm 41 is pivotally mounted to the bracket plate 35 by a second pivot pin 43. This second pivot pin 43 is positioned through both plate members of the bracket plate 35 at a point upwardly and outboardly from the first pivot pin 39.

The second lever arm 41 carries the transducer mounting bracket 19 which is fixedly positioned on the second lever arm 41 by means of a bolt clamping assembly 45. The transducer 15 is mounted to one of a plurality of positioning slots 47 in the transducer mounting bracket 19 by a pin 49 or bolt equivalent thereof.

The first lever arm 37 and the second lever arm 41 are linked together by a pair of short linking arms not shown in FIG. 3 but discussed further below. These linking arms are connected to the twin leg portion 37*b* of the first lever arm 37 by the link pin 51 shown in FIG. 3. This linkage between the first lever arm 37 and the second lever arm 41, in connection with the respective lever end pivot pins 39 and 43 locations causes the two lever arms 37, 41 to rotate together when the first lever arm 37 is moved. The path transcribed by each lever arm is an arc path. However, the two lever arms 37, 41 transcribe two different, non-concentric arcs of pivotal movement.

A roll pin 53 extending through the second lever arm 41 acts as a positioning stop for the downward pivoting of the first lever arm 37. This position stop, established by the roll pin 53, fixes the downward extended position of the second lever arm 41 in the vertical position. When the second lever arm 41 is in this position the stop point of the first lever arm 37 abuts the roll pin stop 53. With this position established, the transducer 15 is facing vertically downwardly and extends below the bottom line of the boat 11.

Figure 4:
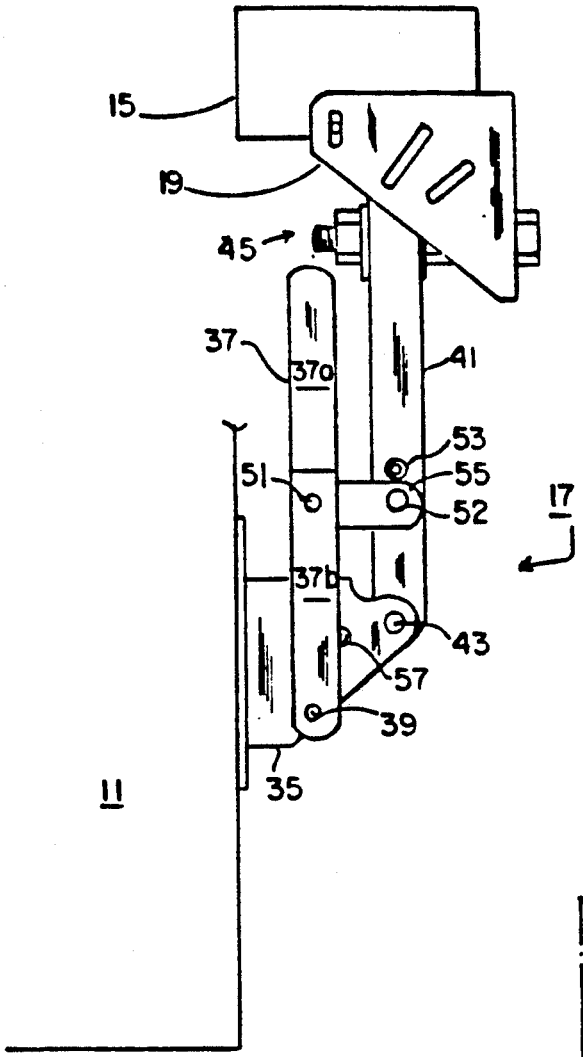
FIG. 4 shows a side view of the retractor device of the present invention in the fully retracted position.

FIG. 4 shows the retractor device 17 in the fully retracted upward position. In this position, the first lever arm 37 and the second lever arm 41 are both extending vertically upwardly, with the second lever arm 41 being positioned in parallel with the first lever arm 37 and outboard thereto. As shown in this view, FIG. 4, one of the pair of the link arms 55 which extends between an intermediate point on the first lever arm 37 and a intermediate point on the second lever arm 41 is clearly shown. Also shown is a male detent button 57 on the outer face of one of the plate members of the bracket plate 35. The operation of this detent button 57 will be explained in further detailed below. It should be noted, that when the second lever arm 41 extends vertically upwardly, the face of the transducer 15 is likewise extending vertically upwardly. This provides easy storage and access for cleaning or servicing the transducer.

Figure 4A:
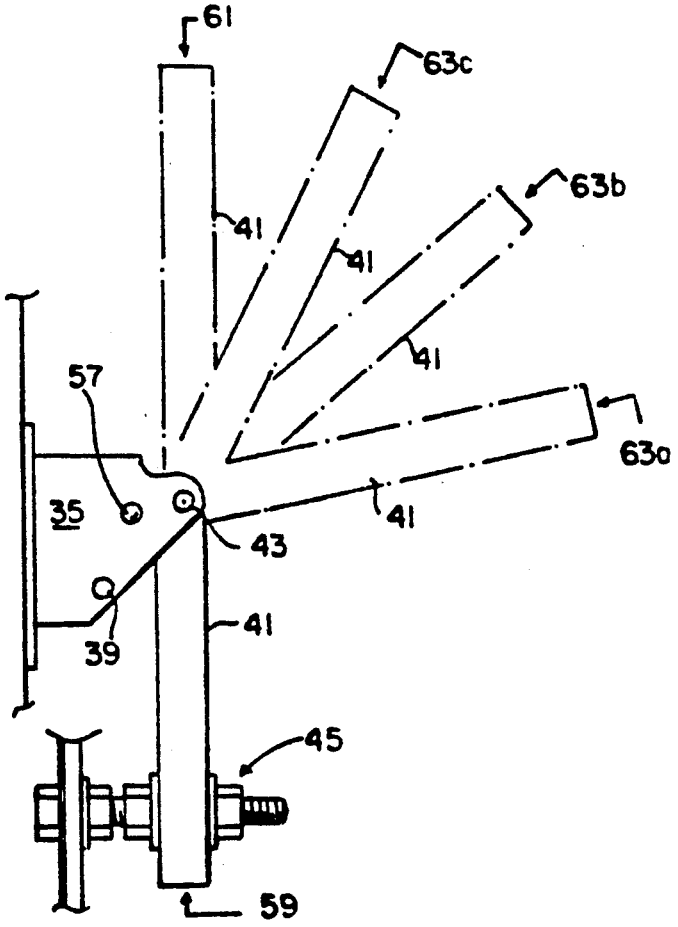
FIG. 4*a* shows the fully extended and fully retracted positions for the transducer holding/mounting lever arm and three intermediate detent positions.

Shown in FIG. 4*a* are the various fixed positions for the second lever arm 41. These positions include the vertically downwardly extending position 59, the vertically upwardly extending position 61 and three intermediate rotational positions 63*a*, 63*b*, and 63*c*, respectively. These intermediate positions 63*a, b* and *c* are established by the cooperation of female detent dimples, which will be discussed below, and the male detent dimple 57, shown in this FIG. 4*a*.

The transducer mounting bracket 19 is shown in greater detail in FIGS. 5*a* and b. This bracket is a U-shaped channel member having a web back member 19*a* and two parallel extending side members 19*b* and 19*c*. Each of the side members 19*b* and 19*c* carry the plurality of slots 47 described above. The back web 19*a* of this mounting bracket 19 has a bolt hole 65 therethrough which the bolt clamping assembly 45, seen in greater detail in FIG. 6, extends. This bolt clamping assembly 45 contains a threaded stud member 67 and a plurality of nuts 69. A pair of washers 71 are positioned between a first two of these nuts 69 and juxtaposed to one another. These washers define the clamping surface for amounting to the second lever arm 41.

The base mounting bracket is shown in greater detail in FIGS. 7*a* and 7*b*. This part comprises a rectangular flat mounting plate 33 and the "U" shaped bracket plate 35 welded or otherwise detached to the mounting plate 33 so as to extend at right angles outwardly therefrom. On the outside of one of these plate members of the bracket plate 35 is the male detent button 57.

The second lever arm 41 is shown in greater detail in FIGS. 8*a* and 8*b* along with the roll pin stop 53. This second lever arm 41 contains a first end pivot hole 73 through which the pivot pin 43 extends and a second, inboard, intermediate point, pivot hole 75 through which a connecting pivot pin 52 for the link arm 55 extends. The roll pin 53 stop member extends through a third hole 77. The outboard end of the second lever arm 41 contains a slot 79 through which the bolt clamping assembly 45 operates to fixedly position the transducer mounting bracket which is otherwise slidably positionable within the slot 79.

The first lever arm 37 is shown in greater detail in FIGS. 9*a* and 9*b*. This lever arm is made out of two pieces which are welded together to form the single leg portion 37*a* and bent apart portion to form the parallel leg extending portion 37*b*. The parallel leg portion 37*b* has an end hole 81 and an inboard hole 83. Pivot pin 39 extends through the hole 81 and pivot pin 51 extends through the hole 83.

Located on the inside of one of the parallel extending legs 37*b* are three female detent dimples 85*a*, 85*b* and 85*c*. These detent dimples 85*a, b, c* are positioned along an arc line 87, this being the arc transcribed by the rotation of the first lever arm 37. These females detent dimples 85*a*, 85*b* and 85*c* co-act with the male detent dimple 57 to establish the fixed detent positions 63*a*, 63*b* and 63*c* shown in FIG. 4*a*.

The pair of link arms 55 are shown in FIG. 10. These link arms each have a pair of holes 89, 91, one at either end thereof, these holes 89, 91 being used for the connecting pins 51, 52. Pin 52 has an enlarged button head and extends through hole 75 of the second lever arm 41 and hole 83 of the first lever arm 37 with the round button head operating adjacent to the female detent dimples 85*a, b, c*. With this cooperation the pin 52 round button head operates as a positive detent lock for the second lever arm 41 in the vertically downward extended position 59.

As is realized from the above description and from viewing FIGS. 3, 4, and 4*a*, the transducer 15 is rotatable over an arc of 180 degrees from its vertical downward position shown in FIG. 3 to its vertical upward positions shown in FIG. 4. This is likewise true for the transducer carrying lever arm 41. In rotating their vertical downward position to its vertical upward position, the lever arm 41 and the transducer 15 rotate through an arc in excess of 90 degrees. FIG. 4*a* shows intermediate positions 63*a*, 63*b*, 63*c* for this structure, all being above the horizontal plane of the pivot pin about which they rotate.

The pivot pins 39, 43, 51, 52 are welded to the outermost face of the outermost member assembled on that pin. This holds the assembly 17 together during jarring.

A retractor device is preferably made of metal. Of the various metals available, type 304 stainless steel is the metal of choice. However, the various components of the retractor device 17 can be made of other types of materials such as reinforced fiberglass and other synthetic construction components.

While the above-description is intended to be illustrative of the invention, it is not intended to limit the intent and scope of the invention. Variations can be made to this device without departing from the intent and scope of the present invention. As an example, the first activator lever 37 can be replaced by a rod operating within a guide and connected to the second lever 41 through a crank arm structure. Further, the rotating composite lever structure shown above could be replaced, at least in part, by a telescoping pole having an end cam mechanism causing the transducer to rotate at either end of its travel.

It is therefore intended that the above-description be read as illustrative of the invention and not be taken in the limiting sense.

What is claimed is:

1. An acoustic transducer retractor device for mounting to the vertical extending face of a pleasure boat transom, comprising:

a base mounting member capable of being fixedly positioned to said transom vertical face at a point near the water line of said boat hull and having a portion thereof extending horizontally thereout from;

a transducer carrying lever member pivotally connected to said base mounting member and pivotally movable in a vertical plane between a first transducer position and a second transducer position, said first transducer position being below the bottom line of said boat hull, said second transducer position being above the water line of said boat hull;

an activator lever member pivotally connected to said transducer carrying lever member and operative thereupon, said activator member being selectively pivotally movable in a vertical plane between a first activator position and a second activator position, said activator lever member causing said transducer carrying lever member to move to said first transducer position when said activator lever member is in said first activator position and causing said transducer carrying lever member to move to said second transducer position when said activator lever member is in said second activator position; and a detent mechanism operating against said activator lever member, said detent mechanism establishing at least one intermediate fixed position for said activator member.

2. The retractor device of claim 1 wherein said transducer carrying member faces said transducer downwardly in said first transducer position and upwardly in said second transducer position.

3. The retractor device of claim 2 wherein said activator lever member pivotal connection to said base mounting member places said activator lever member in a horizontal plane when in said first activator position and wherein said transducer carrying lever member pivotal connection to said base mounting member places said transducer carrying lever member in a vertical plane when in said first transducer position.

4. The retractor device of claim 3 wherein said base mounting member includes a mounting plate positionable to said transom vertical face and a bracket plate extending outwardly from said mounting plate.

5. The retractor device of claim 4 wherein said activator member includes a first lever arm pivotally mounted to a first pivot point on said bracket plate, said first lever arm being connected to said transducer carrying lever member.

6. The retractor device of claim 5 wherein said transducer carrying member includes a second lever arm pivotally mounted to a second pivot point on said bracket plate, said second lever arm having a connection at a midpoint thereon to a connection at a midpoint of said first lever arm, said second lever arm being adaptable to carry said transducer.

7. The retractor device of claim 6 wherein said first lever arm connection to said second lever arm connection is by a linking arm connecting an intermediate length point on said first lever arm to an intermediate length point on said second lever arm.

8. The retractor device of claim 7 wherein said linking arm connecting said first and second lever arms causes said second lever arm to move when said first lever arm is moved, said first and second lever arms transcribing two different non-concentric arcs of pivotal movement.

9. An acoustic transducer retractor device for mounting to the vertical extending face of a boat transom, comprising:

a base mounting member capable of being fixedly positioned to said transom vertical extending face and having a bracket plate extending outwardly from said transom face, said bracket plate lying in a vertical extending plane;

a first lever arm pivotally mounted to a first pivot point on said bracket plate and having a first position extending horizontally outwardly;

a second lever arm pivotally mounted to a second pivot point on said bracket plate and having a first position extending vertically upwardly;

a linking arm connecting an intermediate length point on said first lever arm to an intermediate length point on said second lever arm;

wherein said linking arm connecting said first and second lever arms causes said second lever arm to move when said first lever arm is moved, said two lever arms transcribing two different non-concentric arcs of pivotal movement; and wherein said first lever arm has an outboard single leg portion and an inboard, twin leg portion, the pivot point to said bracket plate being adjacent said inboard portion thereof.

10. The retractor device of claim 9 wherein said twin legs of said first lever arm extend parallel to one another and wherein said pivotal connection to said bracket plate is a pin connection through said bracket plate and both of said parallel extending twin legs.

11. The retractor device of claim 10 also including a detent structure extending between said first lever arm and said base bracket.

12. The retractor device of claim 11 wherein said detent structure includes a male detent button positioned on one face of said base bracket and a plurality of mating female detent dimples on an adjacent inside face of one of said two parallel extending twin legs.

13. The retractor device of claim 12 wherein said base bracket is a U-shaped plate having two parallel extending sides and wherein each of said first and second lever pivot points is an individual pin extending through both said parallel extending sides.

14. The retractor device of claim 13 wherein said linking arm includes a pair of parallel extending link arms pinned between said first lever and said second lever with a first link arm pivot pin and a second link arm pivot pin.

15. The retractor device of claim 14 also including a second male detent button, said second male detent button being positioned on the end of said second link arm pivot pin and being adjacent said plurality of mating female detent dimples when said second lever arm is in the extended position essentially vertically downwardly.

16. The retractor device of claim 15 also including a transducer mechanical coupling member for positioning a transducer on said second lever arm.

17. The retractor device of claim 16 wherein said mechanical coupling member is located on said second lever arm outboard from said pivot point and said link intermediate length connection point.

18. The retractor device of claim 17 wherein said mechanical coupling member is a transducer mounting bracket.

19. The retractor device of claim 18 wherein said second lever arm has a slotted outboard portion of its length; and wherein said transducer coupling bracket is attached through said slotted outboard portion of said second lever arm and slidably and fixedly positionable along said slotted portion.

20. An acoustic transducer retractor device for mounting to the vertical extending face of a pleasure boat transom and for selectively positioning a transducer into and out of the water, comprising:

a base mounting member capable of being fixedly positioned to said transom vertical face at a point near adjacent to and above the water line of said boat and having a portion extending horizontally thereout from;

a transducer carrying lever member pivotally connected to said base mounting member and pivotally movable in a vertical plane between a first transducer position and a second transducer position, said first transducer position being below the bottom line of said boat, said second transducer position being above a horizontal plane parallel to the water line thereby defining a rotational traversal well in excess of 90 degrees;

an activator lever member pivotally connected to said base member and pivotally connected to said transducer carrying lever member said activator lever member being selectively operative thereupon, said activator lever member being selectively pivotally movable in a vertical plane between a first activator position and a second activator position, said activator lever member selectively operating on said transducer carrying lever member to selectively move said transducer carrying lever into said first transducer position when said activator lever member is selectively moved into said first activator position and operating on said transducer carrying lever member to selectively move said transducer carrying lever to said second transducer position when said activator lever member is selectively moved into said second activator position.

21. The acoustic retractor device of claim 20 wherein said first activator position for the activator lever member is a horizontal position and wherein said second activator position for the activator lever member is a vertical position.

* * * * *